US005794603A

United States Patent [19]

Miyamoto

[11] Patent Number: 5,794,603

[45] Date of Patent: Aug. 18, 1998

[54] IGNITION COIL DEVICE

[75] Inventor: Masao Miyamoto, Yokkaichi, Japan

[73] Assignee: Sumitomo Wiring Systems, Ltd., Japan

[21] Appl. No.: 803,237

[22] Filed: Feb. 20, 1997

[30] Foreign Application Priority Data

Feb. 20, 1996 [JP] Japan ..... 8-032080

[51] Int. Cl.[6] ..... F02P 13/00

[52] U.S. Cl. ..... 123/634; 123/647; 123/650

[58] Field of Search ..... 123/634, 635, 123/647, 650, 654

[56] References Cited

U.S. PATENT DOCUMENTS

| | | | |
|---|---|---|---|
| 4,893,105 | 1/1990 | Maeda et al. | 336/84 M |
| 4,903,674 | 2/1990 | Bassett et al. | 123/634 |
| 4,903,675 | 2/1990 | Huntzinger et al. | 123/635 |
| 5,146,906 | 9/1992 | Agatsuma | 123/634 |

FOREIGN PATENT DOCUMENTS

| | | | |
|---|---|---|---|
| 0 387 993 | 9/1990 | European Pat. Off. | F02P 13/00 |

*Primary Examiner*—Tony M. Argenbright
*Assistant Examiner*—Hieu T. Vo
*Attorney, Agent, or Firm*—Anthony J. Casella; Gerald E. Hespos; Ludomir A. Budzyn

[57] ABSTRACT

An ignition coil device is provided in which a damaged portion can be exchanged and which requires no connector for connecting a power switch with a wiring harness. Since an ignition coil device 2 is constructed such that a primary coil portion 21 and a power switch 22 are secured by fitting the primary coil portion 21 into a hollow core of a secondary coil portion 23 mounted in advance on an engine 30, the primary and secondary coil portions 21, 23 can be detachably connected via an iron core 21*c* as a magnetic core. Accordingly, only the secondary coil portion 23 having a relatively short life due to the generation of varying high voltage can be easily exchanged. Further, since the power switch 22 and the primary coil portion 21 are integrally or unitarily connected with a wiring harness 40, the construction can be made inexpensive and simple by the deletion of a connector provided in a prior art ignition coil device, thereby enhancing electrical reliability.

10 Claims, 6 Drawing Sheets

IGNITION COIL DEVICE

BACKGROUND OF THE INVENTION

1. Field of the Invention

The present invention relates to an ignition or spark coil device assembled into an ignition system of distributorless ignition type used in an internal combustion engine.

2. Description of the Prior Art

A known ignition coil device assembled into an ignition system of distributorless ignition type is manufactured by winding primary and secondary coils around a bobbin having a magnetic core fitted into its center axis, fitting this bobbin into a case, filling the case with liquid epoxy resin, and curing the liquid epoxy resin. In such an ignition coil device, a connector is detachably connectable with a terminal of a wiring harness and projects from a main body. The case that accommodates the primary and secondary coils and a power switch for adjusting an application of power to the primary coil are integrally formed in the main body. Power to be supplied to the primary coil and signals used for the on-off control are transmitted from the wiring harness to the power switch via this connector.

However, the prior art ignition coil device has a problem in that the entire device has to be exchanged even if only one of the primary and secondary coils is damaged.

Since the connector projects from the main body, a mold for molding the main body is complicated. Further, a mold defect such as a sink mark is likely to occur.

Further, the connector projecting from the main body may restrict the arrangement and design, and adversely affect the arrangement of other engine parts.

Furthermore, the provision of the connector increases an electrical contact surface, resulting in a difficulty in enhancing the electrical reliability of the ignition coil device.

There are other problems with the prior art ignition coil device. For example, the number of the parts is increased by providing the connector; a connector housing is likely to be damaged when the main body is mistakenly dropped; and the reliability of the electrical contact is reduced since vibration is directly transmitted from the engine to the connector.

In view of the above problems, it is an object of the present invention to provide an ignition coil device in which only a damaged portion can be exchanged and which in particular requires no connector for connecting a power switch and a wiring harness.

SUMMARY OF THE INVENTION

According to the invention there is provided an ignition coil device for an ignition system, and in particular a distributorless ignition type used in an internal combustion engine. The ignition coil device comprises a primary coil portion connected or connectable with a power supply means, and a secondary coil portion detachably connected or connectable with the primary coil portion via a magnetic core.

According to a preferred embodiment the ignition coil device further comprises a power switch integrally connected or connectable with the power supply means, in particular with a specified end of a wiring harness. The primary coil portion of the ignition coil device may be integrally or unitarily secured to the power switch.

According to a preferred embodiment of the invention, there is provided an ignition coil device assembled into an ignition system of distributorless ignition type used in an internal combustion engine. The ignition coil device comprises a power switch integrally connected with a specified end of a wiring harness. A primary coil portion is secured integrally to the power switch, and a secondary coil portion is connected detachably with the primary coil portion via a magnetic core.

Accordingly, it is possible to exchange only the secondary coil portion which is likely to have a relatively short life. Further, since the power switch and the primary coil portion are integrally connected with the wiring harness, a connector, which has caused problems in the prior art, can be deleted from the construction. In other words, the construction can be simplified by the deletion of the connector, and a likelihood of damaging the connector can be eliminated. As a result, contacts which cause a reduction in electrical reliability can be reduced.

Preferably, the primary and secondary coil portions both have a substantially tubular shape, and are connected by being concentrically arranged or fitted one outside the other around a center shaft. The center shaft may be formed by the magnetic core.

The primary and secondary coil portions both may have a substantially tubular shape, and may be connected or connectable by being arranged in series in contact with each other around a center shaft, in particular formed by the magnetic core.

Still further preferably, the primary and secondary coil portions are connected or connectable by connecting means.

The center shaft, in particular the magnetic core, may be arranged substantially in parallel with the longitudinal axis of an ignition plug, and particularly may be connected electrically with the secondary coil portion.

The magnetic core may be arranged at an angle different from 0° or 180°, in particular normal to the longitudinal axis of an ignition plug for electrical connection with the secondary coil portion.

According to a further preferred embodiment, the primary coil portion and the secondary coil portion are detachably connected or connectable with each other via the magnetic core in an arrangement direction different from a mount direction of the secondary coil portion on an engine.

Preferably, an outer shape of at least a part of the primary coil portion, in particular of the magnetic core, is adapted to an inner shape of at least a part of the secondary coil portion.

Most preferably, the primary coil portion and the secondary coil portion are arrangeable at least partially one inside the other. In particular the primary coil portion and the secondary coil portion may be coaxially arrangeable or arranged.

These and other objects, features and advantages of the present invention will become more apparent upon a reading of the following detailed description and accompanying drawings.

DETAILED DESCRIPTION OF THE PREFERRED EMBODIMENT

Figure 1:
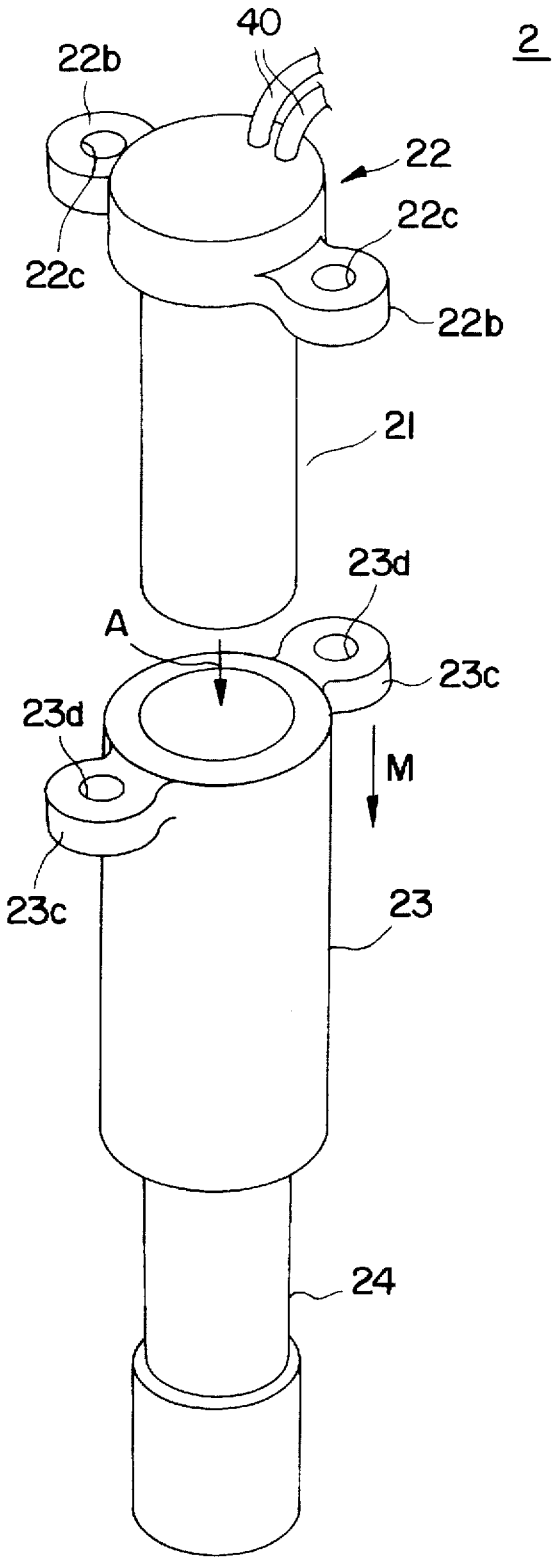
FIG. 1 is a perspective view of an ignition coil device according to a first embodiment.
Figure 2A:
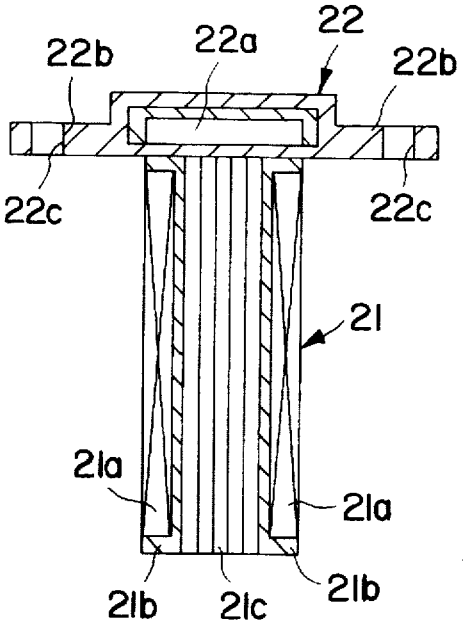
FIG. 2 is a section showing the construction and assembling of the ignition coil device of FIG. 1.
Figure 2B:
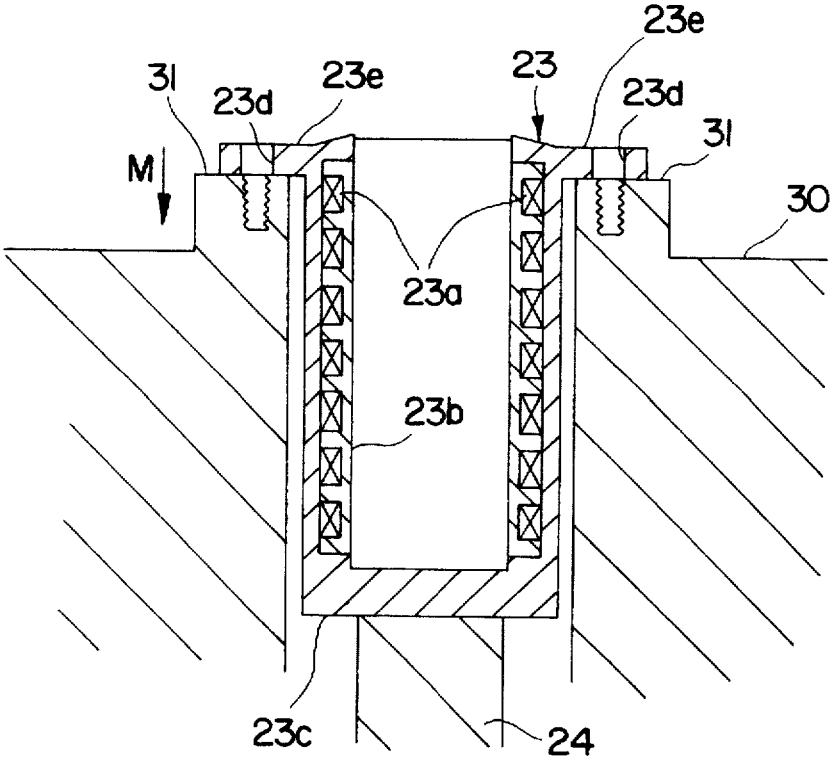

FIG. 1 is an exploded perspective view of an ignition or spark coil device 2 according to a first embodiment, and FIGS. 2(*a*) and 2(*b*) are side views in section of a primary coil portion and a secondary coil portion of the ignition coil device of FIG. 1, respectively.

As is clear from these Figures, the ignition coil device 2 includes a substantially cylindrical primary coil portion 21 having a built-in iron core, a power switch 22 integrally or unitarily secured or connected to the upper end of the primary coil portion 21, a tubular second coil portion 23 in which the primary coil portion 21 can be fitted, and an adapter 24 integrally or unitarily secured to the lower end of the secondary coil portion 23.

As shown in FIG. 2(*a*), the primary coil portion 21 is constructed such that an iron core 21*c* is fitted into a hollow core of a bobbin 21*b* having a primary winding wire 21*a* wound around its outer surface. The outer surface of the primary coil portion 21 is coated with resin so as to prevent the winding wire 21*a* from damage and/or to electrically insulate it from the surroundings.

The power switch 22 is integrally secured to the primary coil portion 21 by filling the primary coil portion 21 with a filler, e.g. a curable or hardenable liquid epoxy resin. The power switch 22 has a built-in switch circuit 22*a* including a power transistor and a driving circuit having a current control circuit and a circuit for protecting the switch against an overcurrent, and is filled with silicone gel or molded with epoxy. The switch circuit 22*a* is directly connected or connectable with ends of a wiring harness 40, making the power switch 22 and the wiring harness 40 integral with each other. The switch circuit 22*a* is also connected with the primary winding wire 21*a* of the primary coil portion 21, and generates and applies a primary current to the primary winding wire 21*a* in accordance with power supplied from the wiring harness 40 and a control signal. Mounts 22*b* each formed with a bolt hole 22*c* are used to secure the power switch 22 and the primary coil portion to an engine 30. The mounts 22*b* are formed integrally or unitarily with the power switch 22 and preferably are at two substantially opposite outer positions thereof.

As shown in FIG. 2(*b*), the secondary coil portion 23 is constructed such that a bobbin 23*b* having a secondary winding wire 23*a* wound around its outer surface is fitted into a hollow substantially cylindrical case 23*c*. The inner shape of the case 23*c* is adapted to the outer shape of the primary coil portion 21, in particular of the bobbin 21*b* and/or of the wound primary winding wire 21. The case 23*c* is secured by curing e.g. liquid epoxy resin filled in the case 23*c*. The lower end of the secondary coil portion 23 is integrally or unitarily connected with the upper end of the adapter 24 connected with an unillustrated ignition plug. The primary coil portion 21 is fitted into a hollow core of the secondary coil portion 23 when the ignition coil device 2 is mounted on the engine 30, with the result that a voltage used for the plug ignition is generated in the secondary winding wire 23*a* by being induced by the primary current flowing through the primary coil portion 21. In two positions on the outer surface of the upper end of the case 23*c*, mounts 23*e* are formed. Each mount 23*e* is formed with a bolt hole 23*d* used to secure the secondary coil portion 23 to a flange 31 of the engine 30. The mounts 23*e* are integrally or unitarily formed with the case 23*c* so as to conform to the mounts 22*b*. The mounts 22*b* of the primary coil portion 22 and the mounts 23*e* of the secondary coil portion 23 can be secured to the flange 31 in the same positions by a pair of bolts while being placed one over the other. It is also possible to secure these mounts 22*b*, 23*e* in different positions by forming stepped portion in the flange 31.

As is clear from the above description, in the ignition coil device 2 according to the first embodiment, the primary coil portion 21 and the power switch 22 are secured by fitting the primary coil portion 21 into the hollow core of the secondary coil portion 23, in particular mounted in advance on the engine 30. The primary and secondary coil portions 21, 23 which are mechanically detachable can be electrically connected via the iron core 21*c* as a magnetic core. Accordingly, only the secondary coil portion 23 having a relatively short life resulting from the generation of varying high voltage can be easily exchanged. Further, since the power switch 22 and the primary coil portion 21 are integrally or unitarily connected with the wiring harness 40, the construction can be made more inexpensive and simple because of the deletion of the connector provided in the prior art ignition coil device, and the electrical reliability can be enhanced due to a decreased contact. Further, the deletion of the connector leads to a more easily shaped and inexpensive mold used for molding the power switch 22 or the like, and makes a molding defect such as a sink mark unlikely to occur. Furthermore, the restriction in arrangement and design to which the prior art is subject due to the projecting connector can be eliminated, thereby increasing a degree of freedom in the layout of other parts. Further, there is no likelihood of damaging the connector housing which occurs with the prior art due to the projecting connector.

Figure 3:
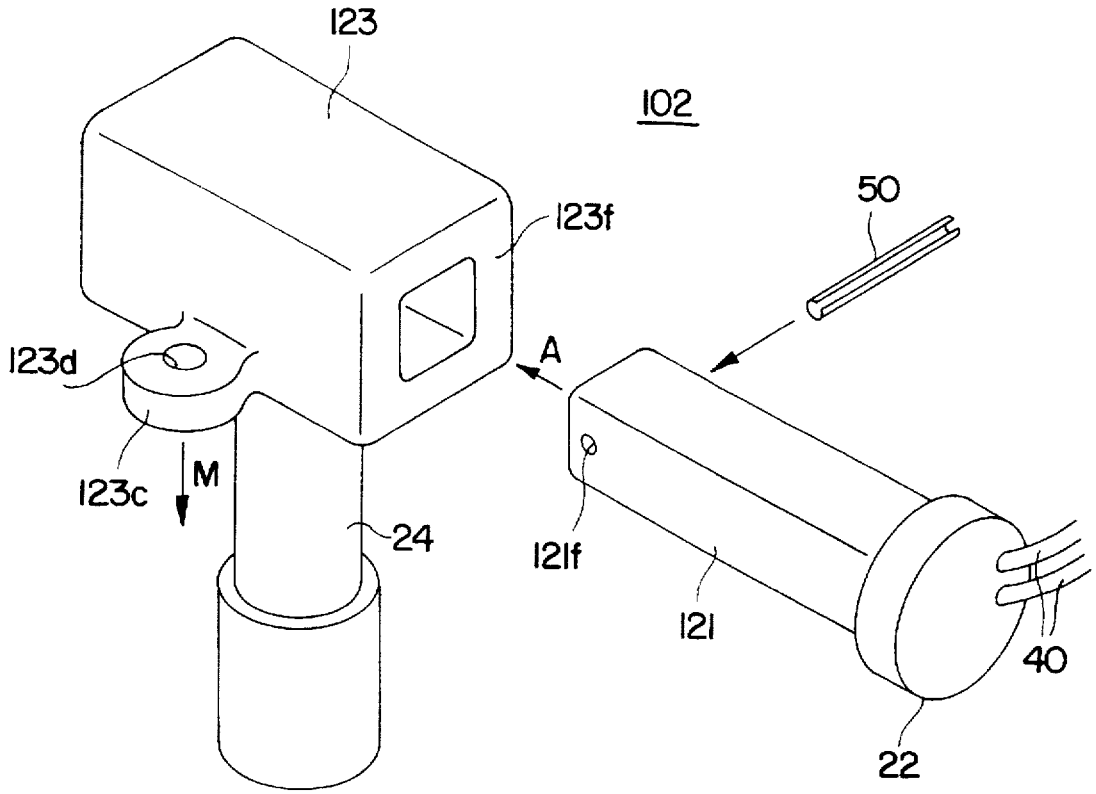
FIG. 3 is a perspective view of an ignition coil device according to a second embodiment.

FIG. 3 is a perspective view showing the construction of an ignition coil device 102 according to a second embodiment. Since the ignition coil device 102 according to the second embodiment is a modification of the ignition coil device 2 according to the first embodiment, no description is given on the same or like elements by identifying them by the same reference numerals. Unlike the ignition coil device 2 according to the first embodiment in which the iron core 21*c* is arranged substantially in parallel with the longitudinal shaft of the ignition plug, an iron core (not shown) is arranged in an arrangement direction A oriented at an angle different from 0° or 180°, preferably normal to the shaft of the ignition plug in the ignition coil device 102 according to the second embodiment, i.e. in an arrangement direction A different from a mount direction M of the secondary coil portion 123 (23) on an engine 30.

The ignition coil device 102 includes a primary coil portion 121 in the form of a substantially rectangular column having a built-in iron core, a power switch 22 integrally or unitarily secured to one end of the primary coil portion 121, a tubular secondary coil portion 123 into which the primary coil portion 121 is fittable, and an adapter 24 integrally or unitarily secured to the lower end of the secondary coil portion 123.

Similar to the primary coil portion 21 as an element of the ignition coil device 2 according to the first embodiment shown in FIG. 2(*a*), the primary coil portion 121 is constructed such that an iron core is fitted into a hollow core of a bobbin having a primary winding wire wound around its outer surface. The primary coil portion 121 is not directly secured to the engine, but secured to the secondary coil portion 123 to be described below. More specifically, when the primary coil portion 121 is fully fitted into the hollow core of the secondary coil portion 123, the leading end of the primary coil portion 121 slightly projects from an end of the second coil portion 123 while an end face of the power switch 22 is engaged with one end face 123*f* of the secondary coil portion 123. A roll pin 50 is inserted through a pin hole 121*f* formed at the leading end of the primary coil portion 121 so as to engage the opposite ends of the roll pin 50 with the other end face of the secondary coil portion 123. In this way, the primary coil portion 121 is secured in the secondary coil portion 123 while being prevented from coming therefrom. The primary coil portion 121 may be secured by being fastened to the end face 123*f* of the secondary coil portion 123 by a screw.

The secondary coil portion 123 is also constructed, similar to the secondary coil portion 23 as an element of the ignition coil device 2 according to the first embodiment shown in FIG. 2(*b*), such that a bobbin having a secondary winding wire wound around its outer surface is fitted into a hollow cylindrical case and is secured by curing e.g. liquid epoxy resin filled in the case. However, since the iron core is arranged in the direction normal to the longitudinal direction of the adapter 24 in the ignition coil device 2 according to the second embodiment, the secondary coil portion 123 is integrally or unitarily formed in its substantially middle position with a mount 123*c* formed with a bolt hole 123*d* used to secure the secondary coil portion 123 to the engine.

Figure 4:
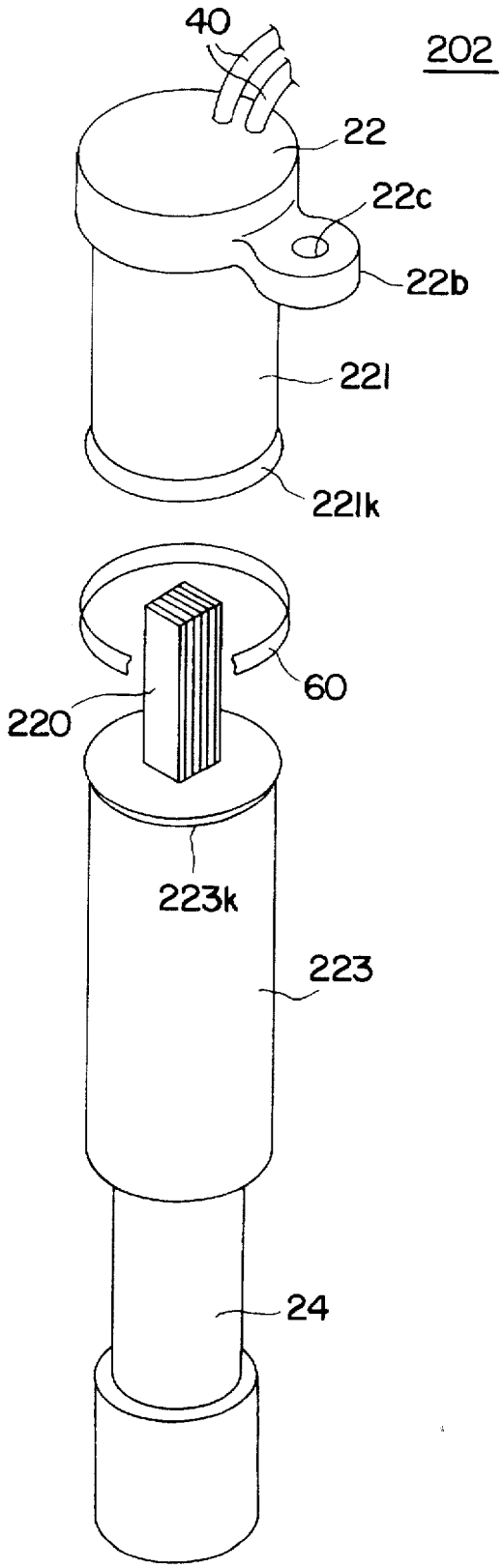
FIG. 4 is a perspective view of an ignition coil device according to a third embodiment.
Figure 5A:
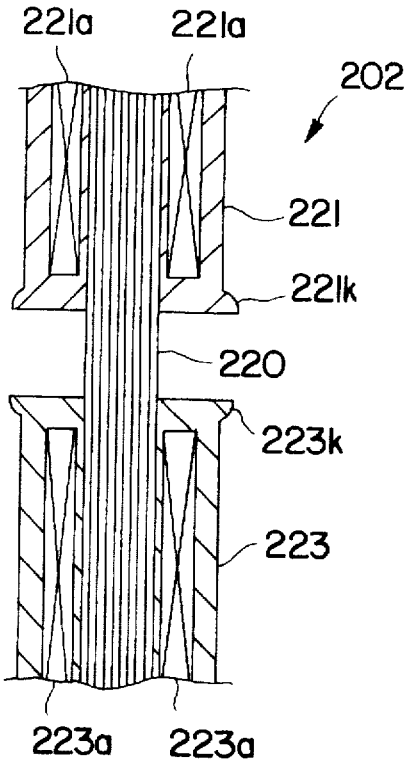
FIG. 5 is a section showing the assembling of the ignition coil device of FIG. 4.
Figure 5B:
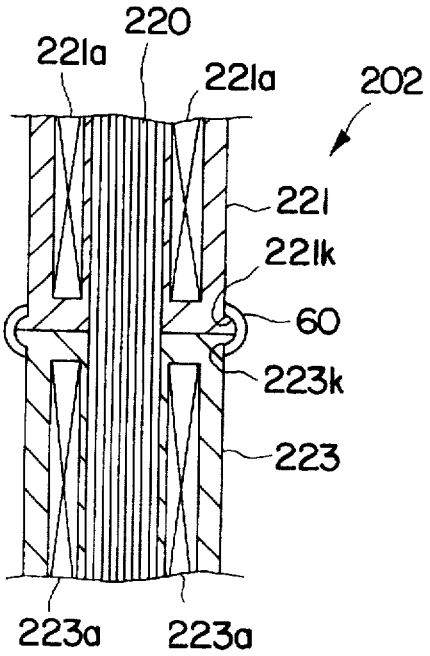

FIGS. 4 and 5 are diagrams showing the construction and assembling of an ignition coil device 202 according to a third embodiment. FIG. 4 is an exploded perspective view of the ignition coil device 202 and FIGS. 5(*a*) and 5(*b*) are sections of a part of the ignition coil device 202 of FIG. 4. Since the ignition coil device 202 according to the third embodiment is a modification of the ignition coil device 2 according to the first embodiment, no description is given on the same or like elements by identifying them by the same reference numerals. Unlike the ignition coil device 2 according to the first embodiment in which the primary coil portion 21 is fitted into the secondary coil portion 23, primary and secondary coil portions 221, 223 are arranged in series in contact with each other in the ignition coil device 202 according to the third embodiment.

More specifically, the ignition coil device 202 includes, as shown in FIG. 4, a cylindrical primary coil portion 221, a power switch 22 integrally or unitarily secured to one end of the primary coil portion 221, a secondary coil portion 223 having the same diameter of the primary coil portion 221, an iron core 220 which is integrally or unitarily fitted in the secondary coil portion 223 and an upper portion of which projects particularly upward from the secondary coil portion 223 toward the first coil portion 221, and an adapter 24 integrally or unitarily secured to the lower end of the secondary coil portion 223.

As shown in FIGS. 5(*a*) and 5(*b*), the primary coil portion 221 is constructed such that a bobbin having a primary winding wire 221*a* wound around its outer surface is fitted and secured in a hollow case, which is in particular substantially cylindrical. A flange 221*k* used for the connection with the secondary coil portion 223 is provided at the lower end of the primary coil portion 221.

As shown in FIGS. 5(*a*) and 5(*b*), the secondary coil portion 223 is constructed such that a bobbin having a secondary winding wire 223*a* wound around its outer surface is fitted into a hollow particularly cylindrical case and is secured by curing e.g. liquid epoxy resin poured into the case, and the iron core is fitted into a hollow core of the bobbin. A flange 223*k* used for the connection with the primary coil portion 221 is provided at the upper end of the secondary coil portion 223.

The primary and secondary coil portions 221, 223 are connected as follows. First, as shown in FIG. 5(*a*), the iron core 220 extending from the secondary coil portion 223 is fitted into the hollow core of the primary coil portion 221, thereby bringing the flanges 221*k*, 223*k* provided at the respective coil portions 221, 223 into contact with each other. Subsequently, as shown in FIG. 5(*b*), the flanges 221*k*, 223*k* are secured using a fittable ring 60. The fittable ring 60 is formed e.g. by archedly bending a thin plate of elastic material in its widthwise direction and curving it into a ring shape in its lengthwise direction. The coil portions 221, 223 may be connected using a thermally shrinkable tube instead of the fittable ring 60. In this case, a more secure connection can be attained.

Figure 6:
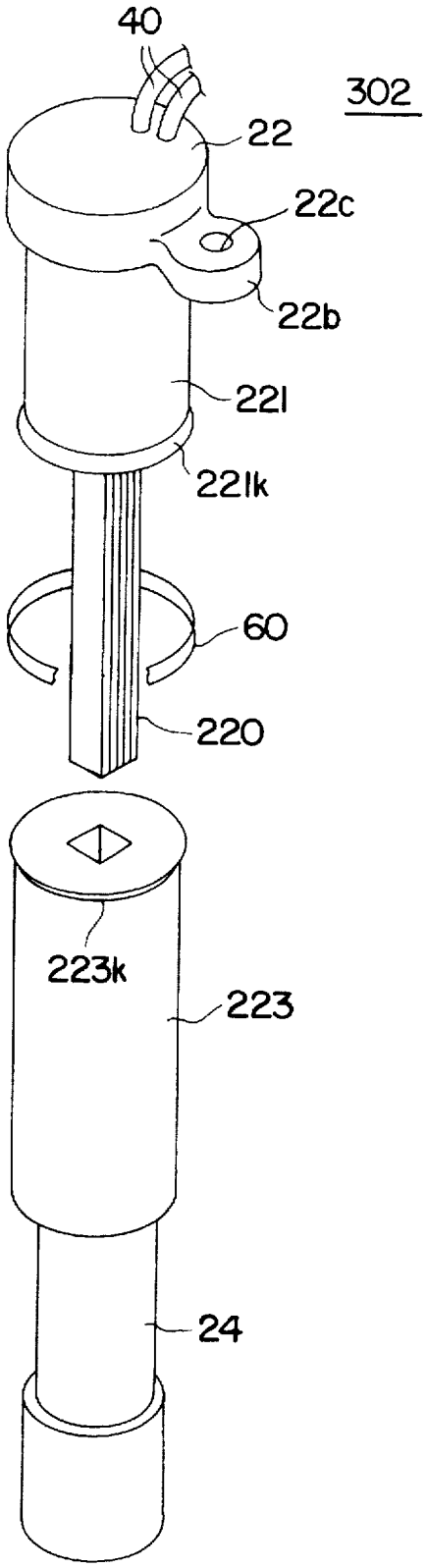
FIG. 6 is a perspective view of an ignition coil device according to a fourth embodiment.

FIG. 6 is an exploded perspective view showing the construction and assembling of an ignition coil device 302 according to a fourth embodiment. The ignition coil device 302 according to the fourth embodiment is a modification of the ignition coil device 202 according to the third embodiment, no description is given on the same or like elements by identifying them by the same reference numerals.

In the ignition coil device 202 according to the fourth embodiment, an iron core 220 is provided at a primary coil portion 221 unlike the ignition coil device 202 according to the third embodiment in which the iron core 22 is provided at the secondary coil portion 223.

What is claimed is:

1. An ignition coil device (2; 102;) for an ignition system in an internal combustion engine, comprising:

a primary coil subassembly, comprising:

a wiring harness (40) having a first end connectable to a power supply and an opposed second end, a power switch (22) connected with the second end of the wiring harness (40), a substantially tubular primary coil portion (21; 121) electrically connected to and integrally secured to the power switch (22), and a magnetic core (21*c*) disposed within the substantially tubular primary coil portion (21; 121), and a secondary coil portion (23; 123) connected to the internal combustion engine and having a hollow tubular shape substantially conforming to the tubular shape of the primary coil portion (21; 121), the primary coil portion being detachably fitted within the hollow tubular secondary coil portion (23; 123) for permitting separation of said primary coil subassembly from the secondary coil portion (23; 123).

2. An ignition coil according to claim 1, wherein the primary coil portion (22; 121; 221) and the secondary coil portion (23; 123; 223) are coaxial in their connected condition.

3. An ignition coil device for an ignition system in an internal combustion engine, comprising: a primary coil portion (221) connectable with a power supply (40), a secondary coil portion (223), and a magnetic core (220) detachably connecting the primary coil portion (221) with the secondary coil portion (223), wherein the primary coil portion (221) and the secondary coil portion (223) both have a substantially tubular shape, and are connected by being arranged in series in end-to-end contact with each other around a center shaft, the center shaft comprising the magnetic core (220).

4. An ignition coil according to claim 3, wherein the primary coil portion (221) and the secondary coil portion (223) are connectable by a mechanical connection (221*k*; 223*k*; 60).

5. An ignition coil device according to claim 3, wherein the magnetic core (21*c*; 220), is aligned substantially parallel with an ignition plug electrically connected with the secondary coil portion (23; 123; 223).

6. An ignition coil device according claim 3, wherein the center shaft comprising the magnetic core is arranged at an angle different from 0° and 180° to the longitudinal axis of an ignition plug electrically connected with the secondary coil portion (123).

7. An ignition coil device according to claim 3, wherein the magnetic core (21*c*; 220), is aligned substantially parallel with an ignition plug electrically connected with the secondary coil portion (23; 123; 223).

8. An ignition coil device for an ignition system in an internal combustion engine, comprising: a primary coil portion (121) connectable with a power supply (40), a secondary coil portion (123), and a magnetic core detachably connecting the primary coil portion (121) with the secondary coil portion (123), wherein a center shaft comprising the magnetic core is arranged at an angle different from 0° and 180° to the longitudinal axis of an ignition plug electrically connected with the secondary coil portion (123).

9. An ignition coil for an ignition system in an internal combustion engine, comprising: a primary coil portion (121) connectable with a power supply (40), a secondary coil portion (123), and a magnetic core detachably connecting the primary coil portion (121) with the secondary coil portion (123), wherein the primary coil portion (21; 121; 221) and the secondary coil portion (23; 123; 223) are detachably connectable with each other via the magnetic core (21*c*; 220) in an arrangement direction (A) different from a mount direction (M) of the secondary coil portion (123) on an engine (30).

10. An ignition coil for an ignition system in an internal combustion engine, comprising: a primary coil portion (121) connectable with a power supply (40), a secondary coil portion (123), and a magnetic core detachably connecting the primary coil portion (121) with the secondary coil portion (123), wherein the magnetic core (21*c*; 220) is secured to the primary coil portion (21; 121; 221) and has an outer shape conforming to an inner shape of at least a part of the secondary coil portion (23; 123; 223).

* * * * *